US007987824B2

(12) United States Patent
Haas et al.

(10) Patent No.: US 7,987,824 B2
(45) Date of Patent: Aug. 2, 2011

(54) DEVICE FOR THE HYDRAULIC CONTROL OF GAS EXCHANGE VALVES OF A RECIPROCATING INTERNAL COMBUSTION ENGINE

(75) Inventors: Michael Haas, Hoechstadt (DE); Eduard Golovatai-Schmidt, Roettenbach (DE); Martin Rauch, Bamberg (DE); Wolfgang Reik, Buehl (DE); Dirk Neubauer, Nachrodt-Wiblingwerde (DE); Detlef Axmacher, Iserlohn (DE); Lars Pfuetzenreuter, Werdohl (DE); Dirk Kenter, Werdohl (DE)

(73) Assignees: Schaeffler KG, Herzogenaurach (DE); Aft Atlas Fahrzeugtechnik GmbH, Werdohl (DE); Luk Lamellen und Kupplungsbau Beteiligungs KG, Buehl (DE)

( * ) Notice: Subject to any disclaimer, the term of this patent is extended or adjusted under 35 U.S.C. 154(b) by 68 days.

(21) Appl. No.: 12/518,966

(22) PCT Filed: Nov. 7, 2007

(86) PCT No.: PCT/EP2007/061957

§ 371 (c)(1),
(2), (4) Date: Sep. 25, 2009

(87) PCT Pub. No.: WO2008/071502

PCT Pub. Date: Jun. 19, 2008

(65) Prior Publication Data

US 2010/0024752 A1 Feb. 4, 2010

(30) Foreign Application Priority Data

Dec. 13, 2006 (DE) ..... 10 2006 058 691

(51) Int. Cl.
*F01L 9/02* (2006.01)

(52) U.S. Cl. ..... 123/90.12; 123/90.13; 123/90.16; 123/90.44; 123/90.6

(58) Field of Classification Search ..... 123/90.11, 123/90.12, 90.13, 90.16, 90.44, 90.6, 90.27, 123/90.31

See application file for complete search history.

(56) References Cited

U.S. PATENT DOCUMENTS

| | | | | |
|---|---|---|---|---|
| 4,047,859 | A | 9/1977 | Sundberg | |
| 7,162,982 | B2 * | 1/2007 | Rabhi | 123/90.12 |
| 2002/0148421 | A1 | 10/2002 | Wiekmeijer | |
| 2006/0102117 | A1 | 5/2006 | Rabhi | |

FOREIGN PATENT DOCUMENTS

| | | | |
|---|---|---|---|
| DE | 31 09 045 | A | 9/1982 |
| EP | 0 571 472 | A | 5/1995 |
| EP | 1 485 621 | A | 10/2005 |
| GB | 1 231 820 | A | 5/1971 |
| WO | 2005/068838 | A | 7/2005 |

* cited by examiner

*Primary Examiner* — Ching Chang
(74) *Attorney, Agent, or Firm* — Lucas & Mercanti, LLP

(57) ABSTRACT

A device for hydraulic control of gas exchange valves of a reciprocating internal combustion engine which has slave cylinders in operative connection with one or more gas exchange valves and master actuators in operative connection with at least one cam provided with a basic and cam profile of a camshaft that is rotatably driven by the engine and can be hydraulically connected to the slave cylinders. The device also has a control device controlled by an actuating member, the device controlling the volume of hydraulic liquid fed to the slave cylinders, and at least one feed line, via which low pressure liquid from a pressure source can be fed to the device by means of at least one non-return valve. The actuators have displaceable vanes, a component carrying the vanes, and cells limited by walls. The vanes are in operative connection with the basic and cam profile of the cam.

25 Claims, 9 Drawing Sheets

12
11
9
14
10
8
13
Z1
Z2
Z3
Z4
26
17
3
5
7
20
19
25
29
23
24
21
2
1

DEVICE FOR THE HYDRAULIC CONTROL OF GAS EXCHANGE VALVES OF A RECIPROCATING INTERNAL COMBUSTION ENGINE

This application is a 371 of PCT/EP2007/061957 filed Nov. 7, 2007, which in turn claims the priority of DE 10 2006 058 691.3 filed Dec. 13, 2006, the priority of both applications is hereby claimed and both applications are incorporated by reference herein.

FIELD OF THE INVENTION

Device for the hydraulic control of gas exchange valves of a reciprocating internal combustion engine, with slave cylinders which are each connected to one or more gas exchange valves, with master actuators which are operatively connected to at least one cam, provided with a basic profile and cam profile, of a camshaft driven rotatably by the reciprocating internal combustion engine and which are connectable hydraulically to the slave cylinders, with a control apparatus which is governed by an actuating member and which controls the quantities of the hydraulic fluid supplied to the slave cylinders, and with at least one supply line, by means of which low-pressure fluid from a pressure source can be supplied to the device by means of at least one nonreturn valve.

BACKGROUND OF THE INVENTION

A generic device of this type for the hydraulic control of gas exchange valves of a reciprocating internal combustion engine is known from U.S. Pat. No. 6,886,511 B1. In this device, each slave cylinder is assigned a displacement piston which is designed as a master actuator and which is connected to a cam arranged on a camshaft. The quantity of the hydraulic fluid supplied to each slave cylinder is controlled via a balancing piston, the abutment of which is governed by an actuating member. Furthermore, a supply line for low-pressure fluid, amongst others for the compensation of leakage losses, is connected to this device via a nonreturn valve. This known device requires a high outlay in terms of construction, since each gas exchange valve or each group of gas exchange valves is assigned a specific unit with an actuating member, etc.

It is known, furthermore, DE-28 13 132, to assign to each gas exchange valve a device for the hydraulic control of the gas exchange valves which consists of a slave cylinder and master cylinder, the control of the hydraulic fluid supplied to the respective slave cylinder taking place via a spill point at the master cylinder and/or slave cylinder.

This device, too, entails a correspondingly high outlay in structural terms.

Furthermore, a device for the hydraulic control of gas exchange valves is known, EP-1 273 770 A2, in which a slave cylinder and a master cylinder each are likewise provided, each unit being assigned a pressure accumulator in which the quantity of hydraulic fluid not intended for the slave cylinder is stored when the control apparatus keeps the spill point into the pressure accumulator open. In this device, the outlay in structural terms is even greater, because the pressure accumulator and the control apparatus are separated.

OBJECT OF THE INVENTION

The object of the invention, therefore, is to provide a device for the hydraulic control of gas exchange valves, which avoids the disadvantages described and reduces the outlay in structural terms.

SUMMARY OF THE INVENTION

The object of the invention is achieved in that the master actuators have cells delimited by movable blades, by a structural element carrying the blades and by walls, and the blades are operatively connected to the basic profile and cam profile of the at least one cam. This configuration gives rise to a pumping unit with a relatively large number of cells which are connected to the particular slave cylinders, so that a plurality of gas exchange valves or groups of gas exchange valves can be actuated by means of only one cam and one structural element.

In a preferred refinement of the invention, the structural element carrying the blades is designed as a stator which surrounds the at least one cam.

This gives rise to a kind of disk-shaped structural unit in which one cam varies the hydraulic volume of a plurality of cells. The stator is preferably of ring-shaped design and has the connections for the slave cylinders.

It is, of course, also possible to design the structural element carrying the blades as a central stator and to arrange the cam as an inner cam on a ring or cylinder.

Depending on the number of cylinders of the reciprocating internal combustion engine, it may be advantageous to provide two or more structural units, each with a cam and with a stator next to one another, the cams being arranged next to one another on a shaft or on a hollow shaft. The number of cells and their assignment to the slave cylinders and also the number of cams must be adapted to the number of cylinders and the ignition sequence of the reciprocating internal combustion engine.

By virtue of this configuration, an appreciable reduction in the outlay in terms of construction and in the costs is obtained, since a plurality of slave cylinders can be controlled by means of a structural unit with one cam and with a stator carrying a plurality of blades.

In order to ensure a good and leak-tight contact between the blades and the cam profile, it is proposed that the blades be loaded in the direction of the cam profile. This may take place, for example, by means of springs or else by means of hydraulic pressure which acts on the blades in the direction of the cam profile.

The build-up of the hydraulic pressure on the blades may take place by means of compensating spaces in the stator, the compensating spaces being connected to a connection for hydraulic fluid and being acted upon with a corresponding pressure.

The hydraulic connection of the master actuators to the slave cylinders takes place preferably by means of hydraulic lines which are connected to the cells and by means of nonreturn valves to the supply line for the low-pressure fluid.

In this case, advantageously, the oil pump of the reciprocating internal combustion engine, which is necessary for lubrication anyway, may serve as a pressure source, since the low-pressure fluid constantly needed is required only for the compensation of leakages and is therefore low.

In a further refinement of the invention, it is proposed to provide spaces between the cells, so that the cells are at a certain distance from one another. Leakage lines may be connected to these spaces and are preferably governed by at least one outflow or pressure relief valve, in order to provide a certain fluid quantity and/or fluid pressure in the spaces as a counterweight to the cells.

If the cam profile of the cam is widened, as seen in the circumferential direction, beyond the degree of the customary valve elevation curve, there is the possibility of producing a wide elevation curve of the gas exchange valves. As a result, for example, greater overlaps between the gas exchange valves at top dead center during operation can be generated or varied. A narrower elevation curve for the respective gas exchange valves can readily be produced by means of the control apparatus in that the quantities of the hydraulic fluid reaching the slave cylinders are varied.

In a preferred refinement of the invention, it is proposed that the control apparatus have outflow orifices which are connected to the cells and the cross section of which is adjustable. For this purpose, outflow apertures corresponding to the number of cells may be provided in at least one wall. As proposed, the wall is designed to be rotatable, the outflow apertures being pivotable between the cells and the adjacent spaces. As a result, depending on the position of the outflow apertures, the cam can control a variation in the quantity arriving at the slave cylinders.

If, according to the invention, the radial extent of the outflow apertures is adapted approximately to the radial extent of the cam profiles, then, depending on the position of the outflow apertures, a zero control of the feed quantity is also possible.

A further preferred refinement of the invention provides for the control apparatus to have balancing pistons which are connected to the hydraulic lines and which are spring-loaded and are connected to adjustable limit stops. The limit stops are preferably designed as abutment tappets and are preferably of pot-shaped type, so that they can receive part of the spring.

The abutment tappets or the balancing pistons have, on the surfaces facing one another, annular grooves which can bring about an end-of-travel damping of the balancing piston with respect to the abutment tappet. In this case, advantageously, either the abutment tappet or the balancing piston has a flange which fits with a step in the second component, so that a central annular groove is obtained.

Advantageously, the abutment tappets are supported on rotatably mounted eccentric disks, whereas the eccentric disks may be fastened on an assigned common shaft which is connected to the actuating member designed for rotary adjustment.

A particularly cost-effective and space-saving embodiment is obtained when the balancing pistons and abutment tappets are arranged, preferably oriented radially, in the structural element carrying the blades. In this case, the abutment tappets may be connected to a control ring having control surfaces which fit with the abutment tappets and the depth of which changes along the circumference. By the control ring being rotated, the control surfaces creep along the abutment tappets, so that the position of the abutment tappets changes in the radial direction and the balancing pistons can execute a larger or smaller balancing movement. In this case, the control ring may be mounted directly on the stator.

Simple adjustment of the control ring and therefore the control apparatus is afforded when the control ring has a gear element, preferably a worm thread, which is connected to a second gear element, preferably a worm. The second gear element is in this case connected to the actuating member, so that a rotational movement of the second gear element causes an adjustment of the quantity of hydraulic fluid arriving at the slave cylinders.

At least one cam, a plurality of cells with assigned components, a plurality of balancing pistons and abutment tappets and also a control ring may be combined into a wheel/disk-shaped structural unit, so that the master actuators can be combined with the assigned control unit into a space-saving and cost-effective unit to which the hydraulic lines to the slave cylinders are connected.

As already mentioned, a plurality of these wheel/disk-shaped structural units may also be provided next to one another.

BRIEF DESCRIPTION OF THE DRAWINGS

For the further explanation of the invention, reference is made to the drawings which illustrate exemplary embodiments of the invention in simplified form and in which.

DETAILED DESCRIPTION OF THE DRAWINGS

Figure 1:
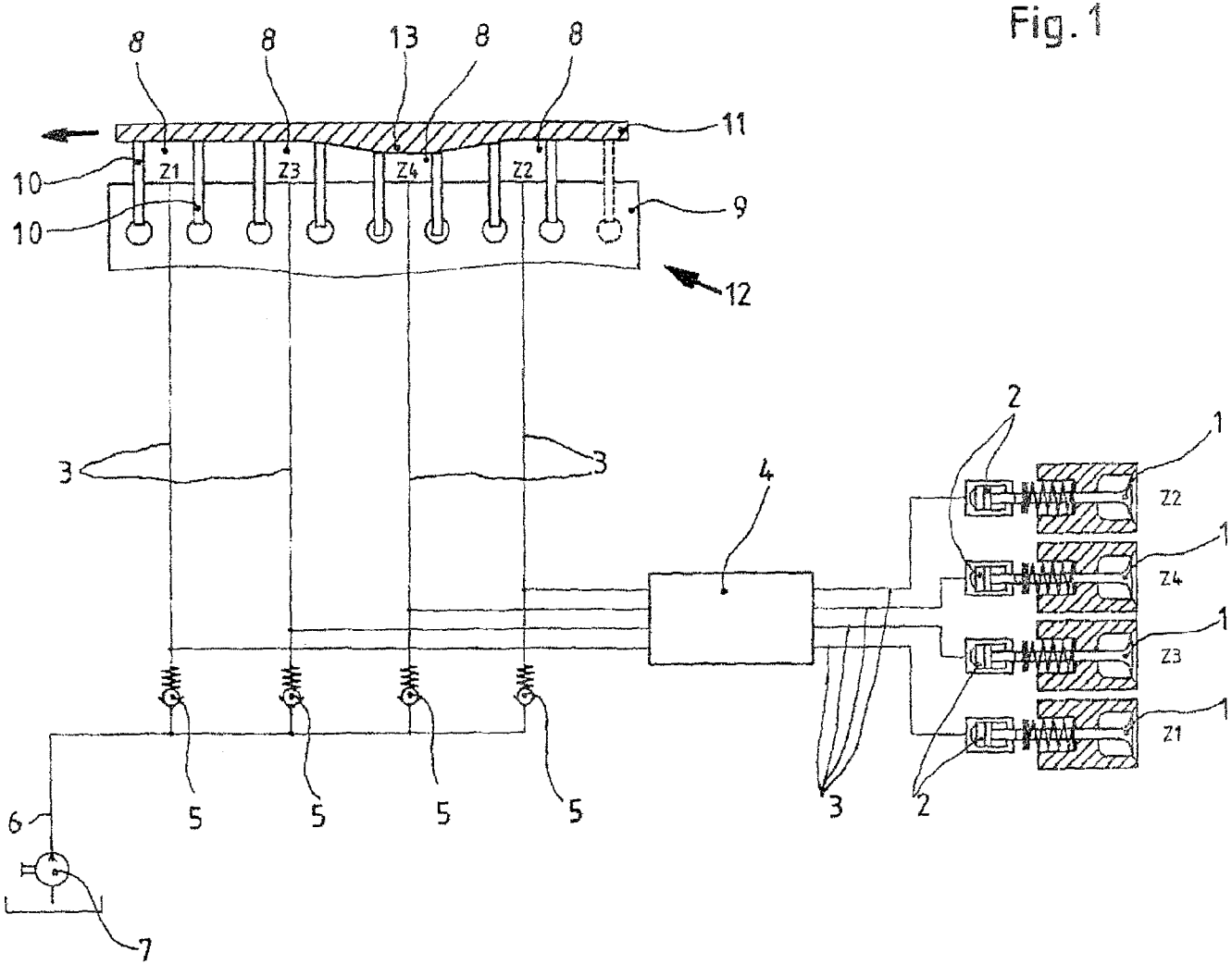
FIG. 1 shows a sketched device for the hydraulic control of gas exchange valves, in which the stator carrying the blades and the cam contour are laid out.

In FIGS. 1 to 13, in so far as they are illustrated in detail, gas exchange valves are designated by 1 which are connected to slave cylinders 2 in such a way that these can open the gas exchange valves under the action of pressure. Connected to each slave cylinder 2 is a hydraulic line 3 which is governed by a control apparatus 4, illustrated as a "black box". The hydraulic lines 3 lead on the other side of the control apparatus 4, after a branch-off, on the one hand, to nonreturn valves 5 which are connected to a supply line 6 for low-pressure fluid, the supply line being connected to an oil pump 7. The hydraulic lines 3, after their branch-off, lead, on the other hand, to cells 8 which are delimited by a stator 9, blades 10 and a cam 11. The cam 11 is guided on a camshaft 35 illustrated in FIG. 13. Lateral delimitation takes place in each case via a wall. The unit composed of cell, stator, blades and cam is also designated as a master actuator 12.

When the cam 11 creeps with its cam profile 13 along the blades 10, the volume in the cells 8 changes, and hydraulic fluid is conveyed through the hydraulic lines 3 to the control apparatus 4 and from there, in the quantity required, to the slave cylinders 2.

Next to the cells 8, spaces 14 are provided, which ensure a distance between the cells 8.

Figure 2:
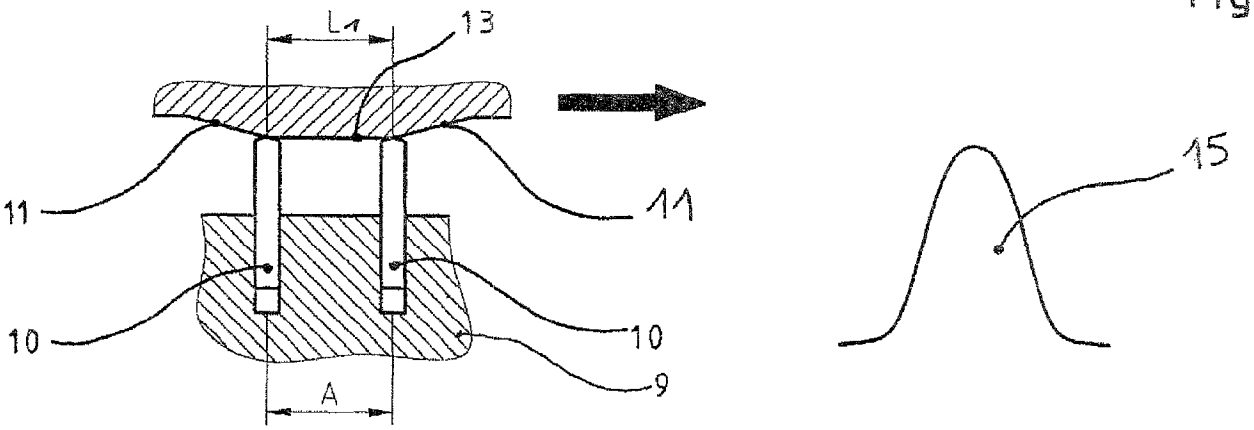
FIG. 2 shows a detail of a stator with two blades and a circumferential extent of the cam profile and also the associated stroke curve of the gas exchange valve.
Figure 3:
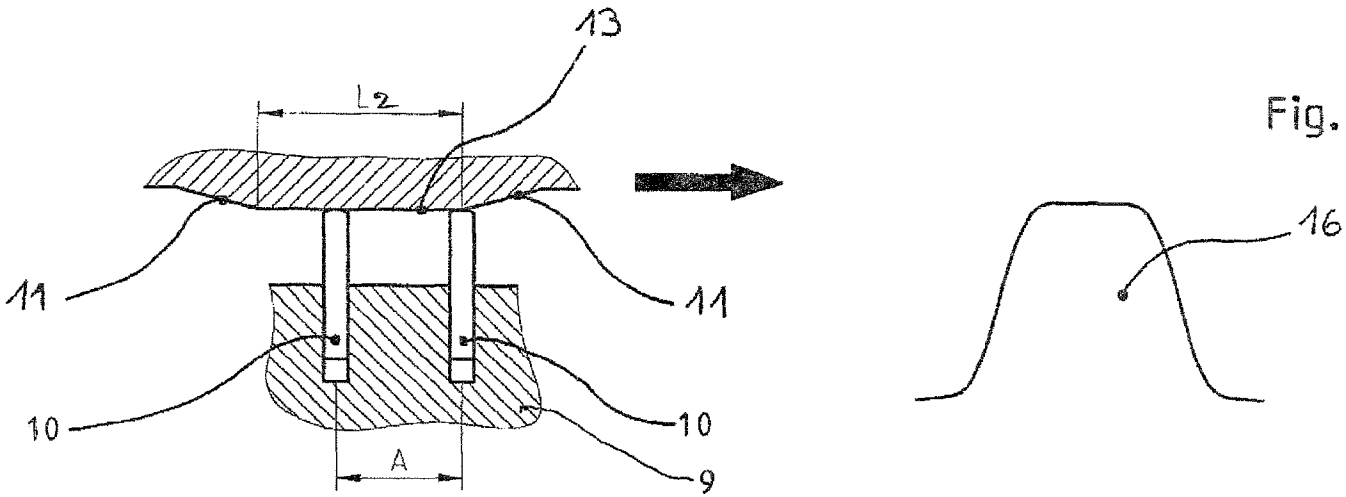
FIG. 3 shows an image, similar to that of FIG. 2, but in which the cam profile is prolonged in the circumferential direction, so that a wider elevation curve is obtained.

In FIGS. 2 and 3, in each of which a cell 8 is illustrated on an enlarged scale and, next to it, an elevation curve for a gas exchange valve, the cam profile 13 has a circumferential extent L1 in FIG. 2, with the result that a stroke curve 15 is generated, while, in FIG. 3, the circumferential extent L2 is substantially greater, so that a wide elevation curve 16 is obtained.

Figure 4:
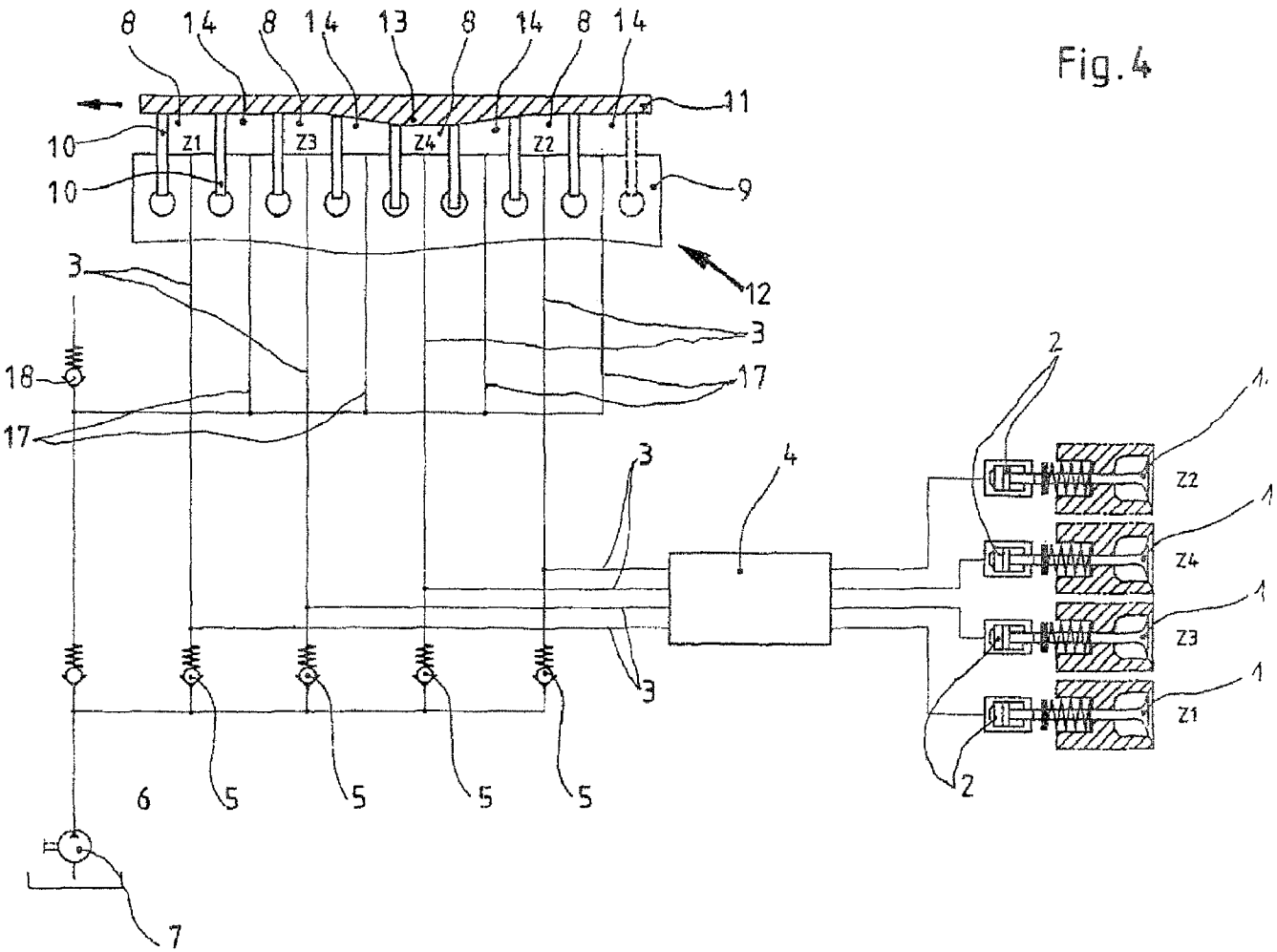
FIG. 4 shows an exemplary embodiment similar to FIG. 1, in which leakage lines are connected to the spaces between the cells.

In FIG. 4, as a supplement to the embodiment according to FIG. 1, leakage lines 17 are connected to the spaces 14 and are governed by an outflow valve 18.

Figure 5:
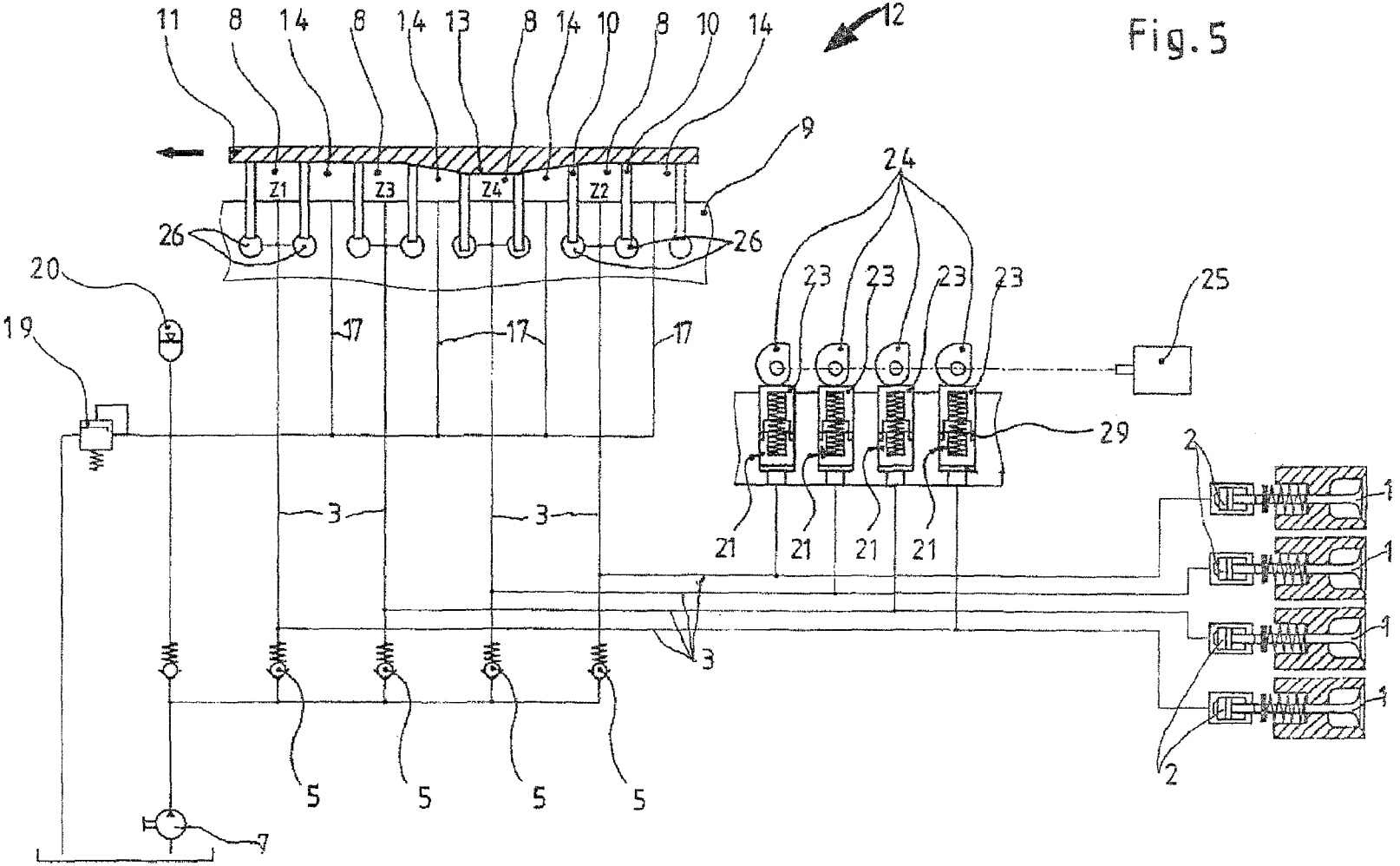
FIG. 5 shows an embodiment similar to FIG. 4, in which balancing pistons are provided for varying the feed quantity.

In the exemplary embodiment according to FIG. 5, the leakage lines 17 have connected to them a pressure relief valve 19 and, furthermore, a pressure accumulator, designated by 20, so that the leakage oil does not flow out of the spaces 14, but is kept at a specific pressure level. Moreover, it may be gathered from FIG. 5 that the control device, designated in general by 4, has balancing pistons 21 which are connected to the hydraulic lines 3. The balancing pistons 21 are loaded by means of compression springs 22 which are supported on abutment tappets 23. The position of the abutment tappets 23 is governed by eccentric disks 24 which are arranged on a shaft, the position of the shaft and consequently of the eccentric disks 24 being fixed by an actuating member 25.

When pressure is built up in the cells 8 due to a reduction in their volume, in this embodiment, too, hydraulic fluid is conveyed through the hydraulic lines 3, while, beyond a certain pressure build-up, the balancing pistons 21 move in the direction of the abutment tappets 23 and pick up a certain quantity of hydraulic fluid until the balancing pistons 21 come to bear against the abutment tappets 23. Only then does the build-up of pressure in the slave cylinders 2 and the opening stroke of the gas exchange valves 1 take place. A coordination of the force of the compression spring 22 with the opening force of the closing springs of the gas exchange valves is self-evident to a person skilled in the art.

From FIG. 5, furthermore, it is clear that the blades 10 in the stator 9 are operatively connected to compensating spaces 26 which are connected via branch-off lines to the respective hydraulic lines 3, so that, when pressure is built up in the cells, a pressure rise in the compensating spaces 26 takes place, with the result that the blades 10 are pressed against the cam profile 13 for better sealing off.

Figure 6:
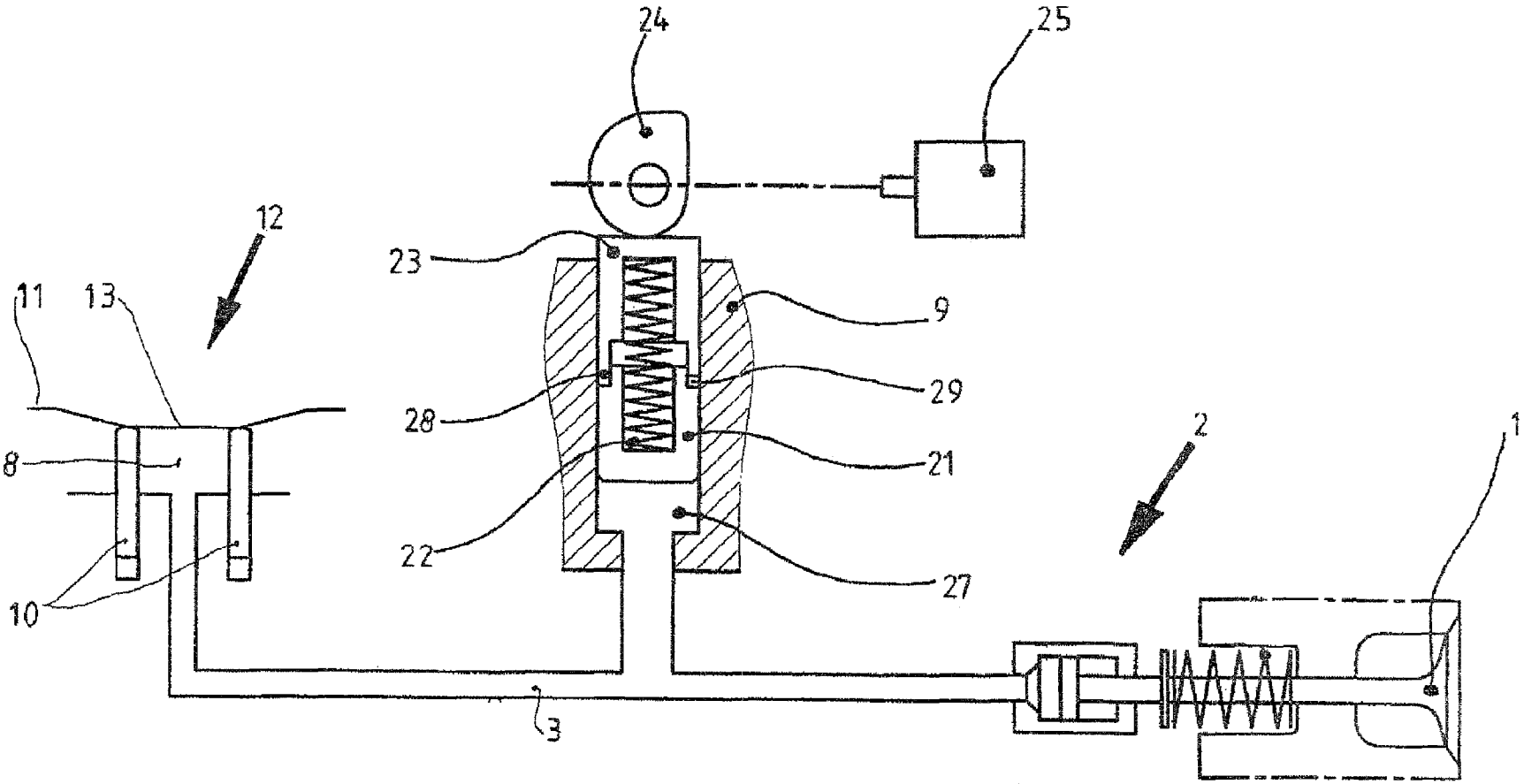
FIG. 6 shows an embodiment in which a cell, a slave cylinder with gas exchange valve and a detail of a control apparatus are illustrated on an enlarged scale.
Figure 7:
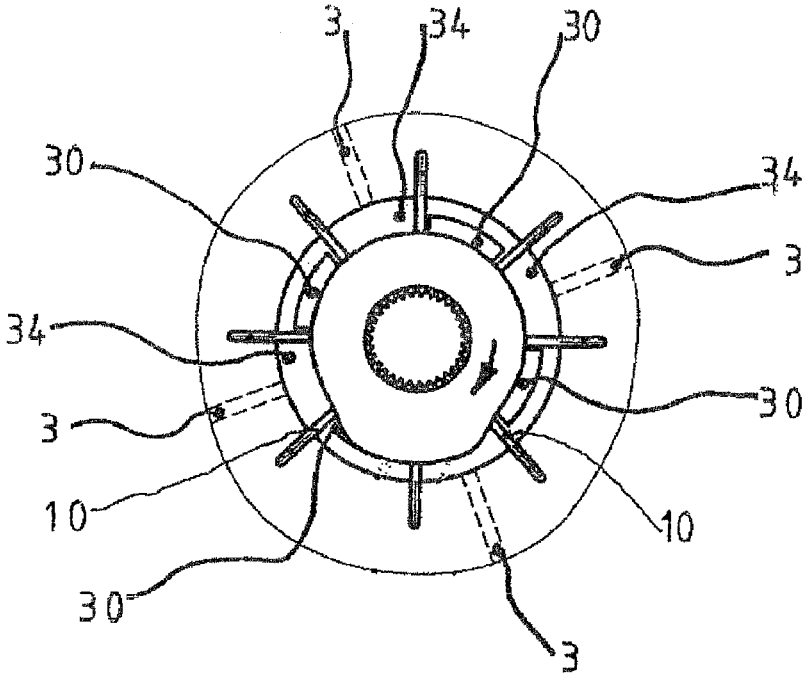
FIGS. 7 and 8 show sections through a master actuator unit with outflow apertures.
Figure 8:
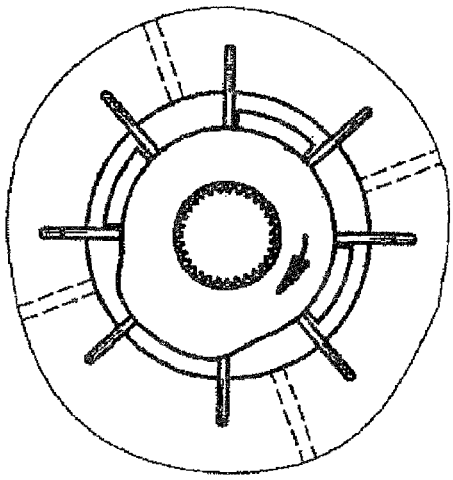

On the enlarged scale of FIG. 6, it is clear that a pressure space 27 which is delimited by the balancing piston 21 is connected to the hydraulic line 3. The abutment tappet 23 has a flange 28 which surrounds a step on the balancing piston. The flange 28 of the abutment tappet 23 forms with the balancing piston 21 an annular groove 29 which serves for the end-of-travel damping of the balancing piston 21 at the abutment tappet 23.

FIGS. 7 to 12 illustrate, amongst others, a wall of the cells 8, which is designated by 34. Outflow apertures 30 are provided correspondingly to the number of cells in the wall 34. Since the wall 34 is rotatable, the outflow apertures 30 can be adjusted such that they lie completely in the spaces 14 or completely in the cells 8.

Figure 9:
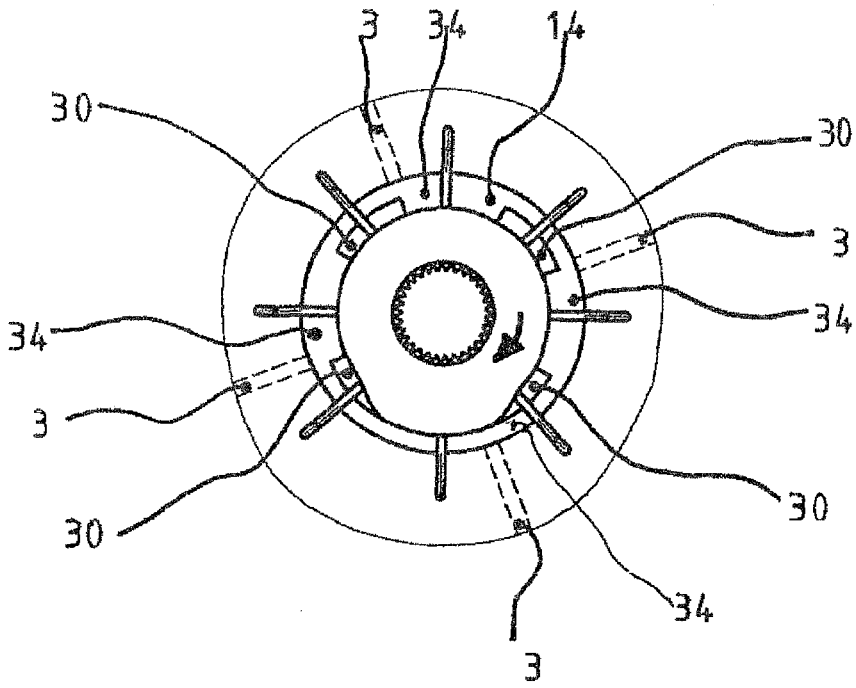
FIGS. 9 and 10 show a section through a master actuator unit according to FIGS. 7 and 8 with a varied position of the outflow apertures.
Figure 10:
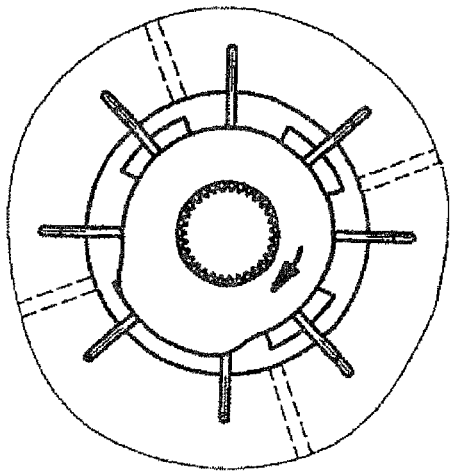

Intermediate positions are also possible, as is illustrated in FIGS. 9 and 10. If the outflow apertures 30 are located in the region of the spaces 14, a regular build-up of the pressure takes place in the cells, with a full conveyance of hydraulic fluid, when the cam profile moves into the cell. If the outflow apertures 30 are located partially in the spaces 14 and partially in the cells 8, specifically in a position which is ahead of the movement of the cam profile, a delayed build-up of pressure, with a reduced feed volume, occurs, as illustrated in FIGS. 9 and 10, because volume can escape into the spaces 14 which in this case are, of course, relieved of pressure or loaded only by slight pressure.

Figure 11:
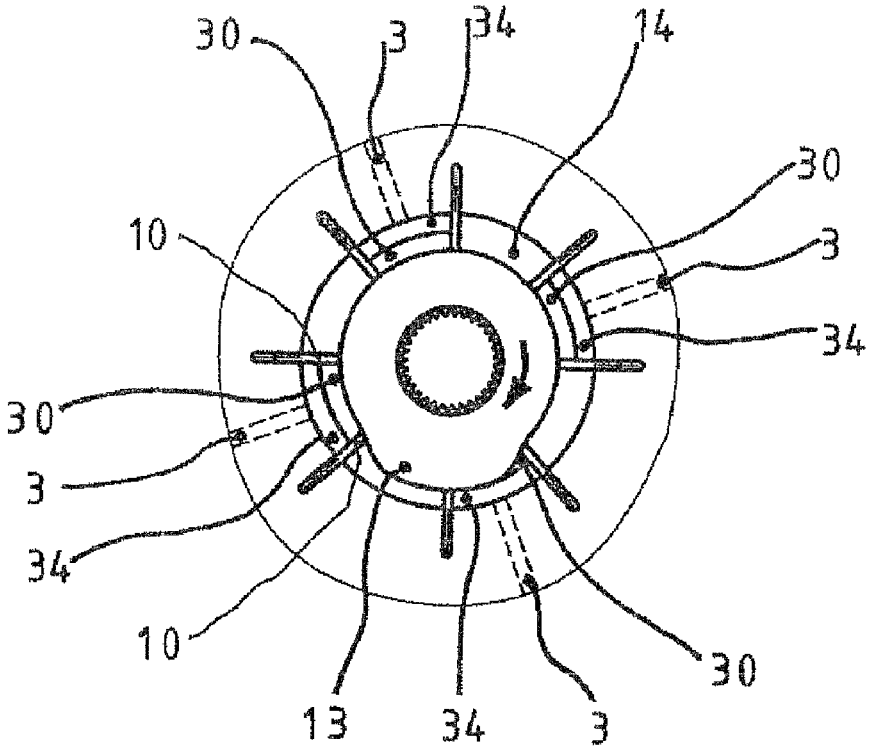
FIGS. 11 and 12 show a section through a master actuator unit according to FIGS. 7 and 8 with a further-varied position of the outflow apertures.
Figure 12:
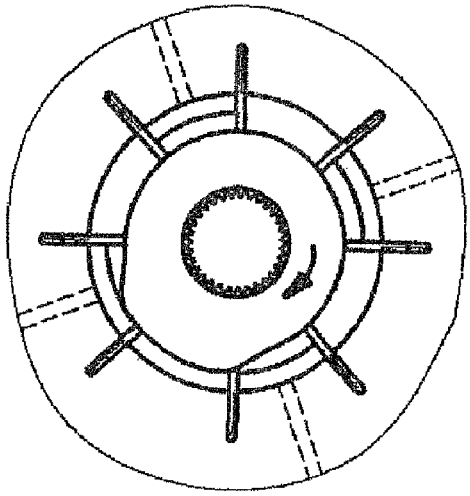

As may be gathered from FIGS. 11 and 12, the outflow apertures 30 have, like the cam profile 13, a radial height such that, when the outflow apertures 30 are located in the region of the cells 8, no appreciable build-up of pressure takes place in the cells 8, since the volume lying radially outside the outflow apertures 30 is not compressed.

Figure 13:
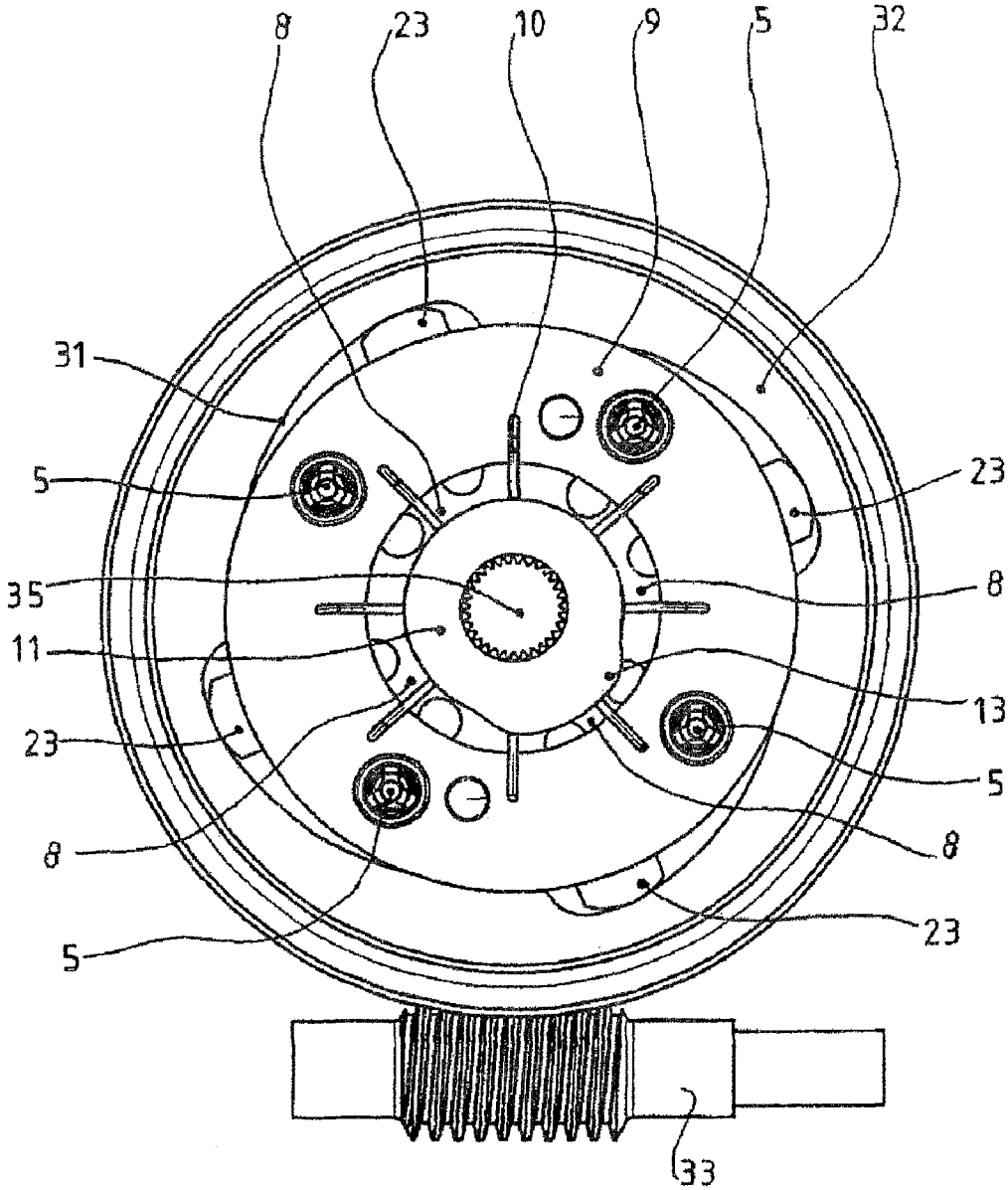
FIG. 13 shows a side view of a structural unit with a cam, cells, a control apparatus and their individual parts.

In FIG. 13, all the components provided for pressure generation and quantity control are combined into a structural unit. The abutment tappets 23 project radially out of the stator 9 and are operatively connected to control surfaces 31 arranged on a control ring 32 which is arranged around the stator 9. The control ring 32 has a worm thread which is operatively connected to a worm, designated by 33, so that, when the axially fixed worm is rotated, the control ring 32 is rotated about the stator 9, as a result of which, via the control surfaces 31, the abutment tappets 23 are moved radially and quantity control thereby takes place.

The structural unit is integrated in so far as the nonreturn valves 5 are also mounted on the stator 9.

| List of Reference Symbols | |
|---|---|
| 1 | Gas exchange valves |
| 2 | Slave cylinder |
| 3 | Hydraulic lines |
| 4 | Control apparatus |
| 5 | Nonreturn valves |
| 6 | Supply line |
| 7 | Oil pump |
| 8 | Cells |
| 9 | Stator |
| 10 | Blades |
| 11 | Cam |
| 12 | Master actuators |
| 13 | Cam profile |
| 14 | Spaces |
| 15 | Stroke curve |
| 16 | Elevation curve |
| 17 | Leakage lines |
| 18 | Outflow valve |
| 19 | Pressure relief valve |
| 20 | Pressure accumulator |
| 21 | Balancing piston |
| 22 | Compression springs |
| 23 | Abutment tappet |
| 24 | Eccentric disks |
| 25 | Actuating member |
| 26 | Compensating spaces |
| 27 | Pressure space |
| 28 | Flange |
| 29 | Annular groove |
| 30 | Outflow aperture |
| 31 | Control surfaces |
| 32 | Control ring |
| 33 | Worm |
| 34 | Wall |
| 35 | Camshaft |

The invention claimed is:

1. A device for hydraulic control of gas exchange valves of a reciprocating internal combustion engine, with slave cylinders which are operatively connected to one or more gas exchange valves, with master actuators which are each operatively connected to at least one cam, provided with a basic profile and a cam profile, of a camshaft driven rotatably by the reciprocating internal combustion engine and which are connectable hydraulically to the slave cylinders, with a control apparatus which is governed by an actuating member and which controls quantities of hydraulic fluid supplied to the slave cylinders, and with at least one supply line, by means of which low-pressure fluid from a pressure source can be supplied to the device by means of at least one non-return valve, wherein the master actuators have cells delimited by movable blades, by a structural element carrying the movable blades and by walls, and the movable blades are operatively connected to the basic profile and the cam profile of the at least one cam.

2. The device as claimed in claim 1, wherein the structural element carrying the movable blades is designed as a stator which surrounds the at least one cam.

3. The device as claimed in claim 1, wherein a number of the cells and the cells assignment to the slave cylinders and the number of the at least one cam are adapted to the number of the slave cylinders and ignition sequence of the reciprocating internal combustion engine.

4. The device as claimed in one of the preceding claims, wherein the movable blades are loaded in a direction of the cam profile by means of springs or hydraulic pressure.

5. The device as claimed in claim 1, wherein the movable blades are operatively connected to compensating spaces in a stator, the compensating spaces being connected to a connection for hydraulic fluid.

6. The device as claimed in claim 1, wherein a hydraulic connection of the master actuators to the slave cylinders takes place by means of hydraulic lines which are connected to the cells and by means of the non-return valves to the supply line for the low-pressure fluid.

7. The device as claimed in claim 1, wherein an oil pump of the reciprocating internal combustion engine serves as a pressure source.

8. The device as claimed in claim 1, wherein spaces are provided between the cells.

9. The device as claimed in claim 8, wherein leakage lines governed by at least one outflow valve or pressure relief valve are connected to the spaces.

10. The device as claimed in claim 1, wherein the cam profile is widened, as seen in a circumferential direction, beyond a degree of a customary stroke curve of a gas exchange valve.

11. The device as claimed in claim 1, wherein the control apparatus has outflow orifices which are operatively connected to the cells and a cross-section of which is adjustable.

12. The device as claimed in claim 11, wherein outflow apertures corresponding to the of cells are provided in at least one wall.

13. The device as claimed in claim 12, wherein the wall is rotatable, the outflow apertures being pivotable between the cells and adjacent spaces.

14. The device as claimed in claim 12, wherein a radial extent of the outflow apertures corresponds approximately to a radial extent of the cam profile.

15. The device as claimed in claim 1, wherein the control apparatus has balancing pistons which are connected to hydraulic lines and which are spring-loaded and are connected to adjustable limit stops.

16. The device as claimed in claim 15, wherein the limit stops are designed as abutment tappets and are pot-shaped for receiving compression springs.

17. The device as claimed in claim 16, wherein the abutment tappets and the balancing pistons form, on surfaces facing one another, an annular groove for end-of-travel damping.

18. The device as claimed in claim 17, wherein the balancing pistons and the abutment tappets are oriented radially in a stator.

19. The device as claimed in claim 18, wherein the abutment tappets are operatively connected to a control ring having control surfaces which fit with the abutment tappets and a radial depth of which changes along a circumference, so that a rotation of the control ring varies the position of the abutment tappets.

20. The device as claimed in claim 19, wherein the control ring is mounted on the stator.

21. The device as claimed in claim 19, wherein the control ring has a gear element, which is connected to a second gear element, the second gear element being connected to the actuating member.

22. The device as claimed in claim 21, wherein the gear element is a worm thread and second gear clement is a worm.

23. The device as claimed in claim 16, wherein the abutment tappets are operatively connected to rotatably mounted eccentric disks.

24. The device as claimed in claim 23, wherein the eccentric disks are arranged on a common shaft which is connected to the actuating member.

25. The device as claimed in claim 1, wherein the at least one cam, a plurality of the cells with assigned components, a plurality of balancing pistons and abutment tappets and a control ring are combined into a wheel/disk-shaped structural unit.

* * * * *